US011293120B2

(12) United States Patent
Ranganathan et al.

(10) Patent No.: US 11,293,120 B2
(45) Date of Patent: Apr. 5, 2022

(54) TOTAL FIT COTTON FABRIC

(71) Applicant: K. G. Denim Limited, Coimbatore (IN)

(72) Inventors: Vijayaragavan Ranganathan, Coimbatore (IN); Neelamegam Krishnamoorthy Janardhanan, Coimbatore (IN); Sundaram Rajesh, Coimbatore (IN)

(73) Assignee: K. G. DENIM LIMITED, Coimbatore (IN)

( * ) Notice: Subject to any disclaimer, the term of this patent is extended or adjusted under 35 U.S.C. 154(b) by 380 days.

(21) Appl. No.: 16/546,817

(22) Filed: Aug. 21, 2019

(65) Prior Publication Data

US 2021/0054544 A1 Feb. 25, 2021

(51) Int. Cl.

| | |
|---|---|
| ***D03D 13/00*** | (2006.01) |
| ***D03D 1/00*** | (2006.01) |
| ***D02J 1/22*** | (2006.01) |
| ***A47G 9/02*** | (2006.01) |

(52) U.S. Cl.

CPC ..... *D02J 1/22* (2013.01); *A47G 9/0238* (2013.01); *D03D 1/0017* (2013.01); *D03D 13/008* (2013.01); *D10B 2201/02* (2013.01); *D10B 2503/06* (2013.01)

(58) Field of Classification Search

CPC ... D02J 1/22; D02J 1/227; D02J 1/224; A47G 9/0238; A47G 9/0246; A47G 9/0253; D03D 1/0017; D03D 13/008; D03D 15/217; D03D 15/225; D03D 15/283; D03D 15/56; D10B 2201/02; D10B 2503/06; D10B 2201/24; D10B 2331/10; D02G 3/328

See application file for complete search history.

(56) References Cited

U.S. PATENT DOCUMENTS

| | | | | |
|---|---|---|---|---|
| 3,967,657 | A * | 7/1976 | Cugini | D03D 47/34 139/450 |
| 4,192,158 | A * | 3/1980 | Kohl | D04B 23/12 66/146 |
| 4,899,425 | A * | 2/1990 | Epple | D06H 3/12 26/51.4 |
| 5,678,779 | A * | 10/1997 | Maina | D03D 47/34 242/365.4 |
| 9,131,790 | B2 | 9/2015 | Agarwal | 9/238 |
| 9,481,950 | B2 | 11/2016 | Agarwal | |
| 9,493,892 | B1 | 11/2016 | Agarwal | |
| 9,689,091 | B2 * | 6/2017 | Liao | D04B 1/12 |
| 9,708,737 | B2 | 7/2017 | Agarwal | 1/17 |
| 10,066,324 | B2 | 9/2018 | Agarwal | 1/17 |
| 10,544,526 | B2 * | 1/2020 | Guleken | D03D 27/04 |

(Continued)

*Primary Examiner* — Robert H Muromoto, Jr.
(74) *Attorney, Agent, or Firm* — Stein IP, LLC

(57) ABSTRACT

A woven textile fabric that is lightweight, soft, smooth, supple and durable has a composition including a regenerated cellulosic fiber, cotton and an elastane fiber such as spandex. The fabric includes warp yarn and weft yarn, and the weft yarn is a core spun yarn made of an elastane fiber core surrounded by a sheath of blended regenerated cellulosic fiber and cotton. The fabric construction may range from about 44 ends/inch to about 300 ends/inch and from about 30 picks/inch to about 600 picks/inch. The warp count may range from 2 s count to 140 s count, and the weft count ranges from 2 s count to 170 s count. The fabric, which can be made using a series of innovative process steps, is particularly useful as a bed linen.

18 Claims, 6 Drawing Sheets

(56) References Cited

U.S. PATENT DOCUMENTS

| | | | | |
|---|---|---|---|---|
| 10,988,868 | B2 * | 4/2021 | Mittal | D03D 15/573 |
| 2006/0128243 | A1 * | 6/2006 | Kong | A41D 31/00 442/182 |
| 2016/0251782 | A1 * | 9/2016 | Liao | D04B 1/18 66/202 |
| 2019/0186055 | A1 * | 6/2019 | O'Hara | D02G 3/36 |
| 2019/0323152 | A1 * | 10/2019 | Ranganathan | D03D 15/00 |
| 2021/0010170 | A1 * | 1/2021 | Ranganathan | D03D 15/00 |

* cited by examiner

SPECIAL MACHINE FOR HEAT SETTING PROCESS

TOTAL FIT COTTON FABRIC

BACKGROUND OF THE INVENTION

1. Field of the Invention

The invention relates generally to a woven textile fabric and more particularly to a woven textile fabric having a composition comprising a regenerated cellulosic fiber, cotton and spandex. The woven textile fabric of the invention may be particularly useful as a bed linen.

2. Description of the Related Art

A good woven textile fabric, such as bed linens or apparel, has a host of characteristics that make it appealing. For example, bed linens, such as sheets, should feel smooth, have lasting softness, absorb moisture, be breathable, and be durable.

Today's over-sized mattresses require non-traditional sheets. Most sheets on the market pop off the corners of an over-sized mattress or fit too tight, creating a drum effect. Tight fitting sheets completely firm up the feel of your mattress and thus are uncomfortable.

Another problem inherent in most traditional sheets and bed linens is that they are not allergen-free. A healthy and comfortable sleep requires sheets that are allergen-free.

An additional problem inherent in traditional sheets is that if they possess adequate stretch characteristics, they do not have a comfortable feel. On the other hand, if they have a comfortable feel, they do not possess adequate stretch characteristics to fit well on deep mattresses. In view of the above, the principal object of the invention is to provide a woven textile fabric and method of making the same that possesses the excellent characteristics discussed above (e.g., smooth feel, lasting softness, moisture absorption, breathability, appropriate fit and stretch) and is durable enough to have longevity, particularly in view of being subjected to frequent machine laundering. Other objects will be apparent from the detailed description of the invention which follows.

SUMMARY OF THE INVENTION

Broadly stated, the objects of the invention are realized, according to one aspect of the invention, by producing a woven textile fabric comprising warp yarn and weft yarn and having a composition comprising a regenerated cellulosic fiber, cotton and an elastane fiber.

According to one aspect of the invention, the elastane fiber is spandex. According to another aspect, the regenerated cellulosic fiber is lyocell.

According to an aspect of the invention, the regenerated cellulosic fiber may be present in an amount ranging from about 65% to about 69%, the cotton is present in an amount ranging from about 27% to about 33%, and the spandex is present in an amount ranging from about 2% to about 4%.

According to another embodiment of the invention, the regenerated cellulosic fiber is present at about 67%, the cotton is present at about 30%, and the spandex is present at about 3%.

In one aspect of the invention the fabric has a 4/1 satin weave.

Broadly speaking the woven textile fabric of the invention may be used as bed linen. The bed linen may be, for example, a pillow cover, a flat sheet, a bottom sheet, a fitted sheet, or a box sheet.

According to one aspect of the invention the thread count may range from about 80 to about 2000. According to another aspect of the invention, the fabric construction may range from about 44 ends/inch to about 300 ends/inch and from about 30 picks/inch to about 600 picks/inch.

According to one aspect of the invention, the warp count of the fabric ranges from 2 s count to 140 s count and the weft count ranges from 2 s count to 170 s count. The stretch range of the fabric may be between about 3% and about 50%.

According to another embodiment of the invention, the woven textile fabric comprises weft yarn and warp yarn, and wherein the weft yard comprises long staple cotton between 28 mm and 36 mm in length in a 50 s count. The weft yarn may range from 15 denier to 150 denier.

According to one aspect of the invention, the weft yarn of the woven textile fabric is a core spun yarn comprising an elastane fiber core surrounded by a sheath of blended regenerated cellulosic fiber and cotton. The spandex content of the weft yarn may be from about 2% to about 12%.

The invention also embraces a method of making the woven textile fiber described in the various embodiments discussed above. According to one aspect of the invention, the method includes the step of reducing the tension in the weft yarn using an electromechanical assembly unit with a batching system and an auto speed electro drive system.

The method of making the fabric of the invention may further include a step of stretching the weft yarn using a PAD dry 4-chamber heating unit with a dwell time of 135 meters, wherein the Chamber 1 temperature is about 170° C., the Chamber 2 temperature is about 170° C., the Chamber 3 temperature is about 180° C., and the Chamber 4 temperature is about 180° C. Each of the four chambers in the heating unit may include an exhaust fan, wherein the exhaust fan setting for Chamber 1 and Chamber 2 is 40%, and the exhaust fan setting for Chamber 3 and Chamber 4 is 60%. Further, the heating unit may have a machine speed between 35 mpm and 40 mpm.

According to another aspect of the invention, the method of the invention may also include a step of batching greige rolls in trolleys and a step of operating a continuous bleaching and Mercerizing range with a tension control system running at less than 2.5 bar air pressure. The tension control system may operate at about 1 bar of air pressure. The method of the invention may further include a calendaring step, wherein the fabric is passed through polytetrafluoroethylene rollers at a temperature of about 70° C.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
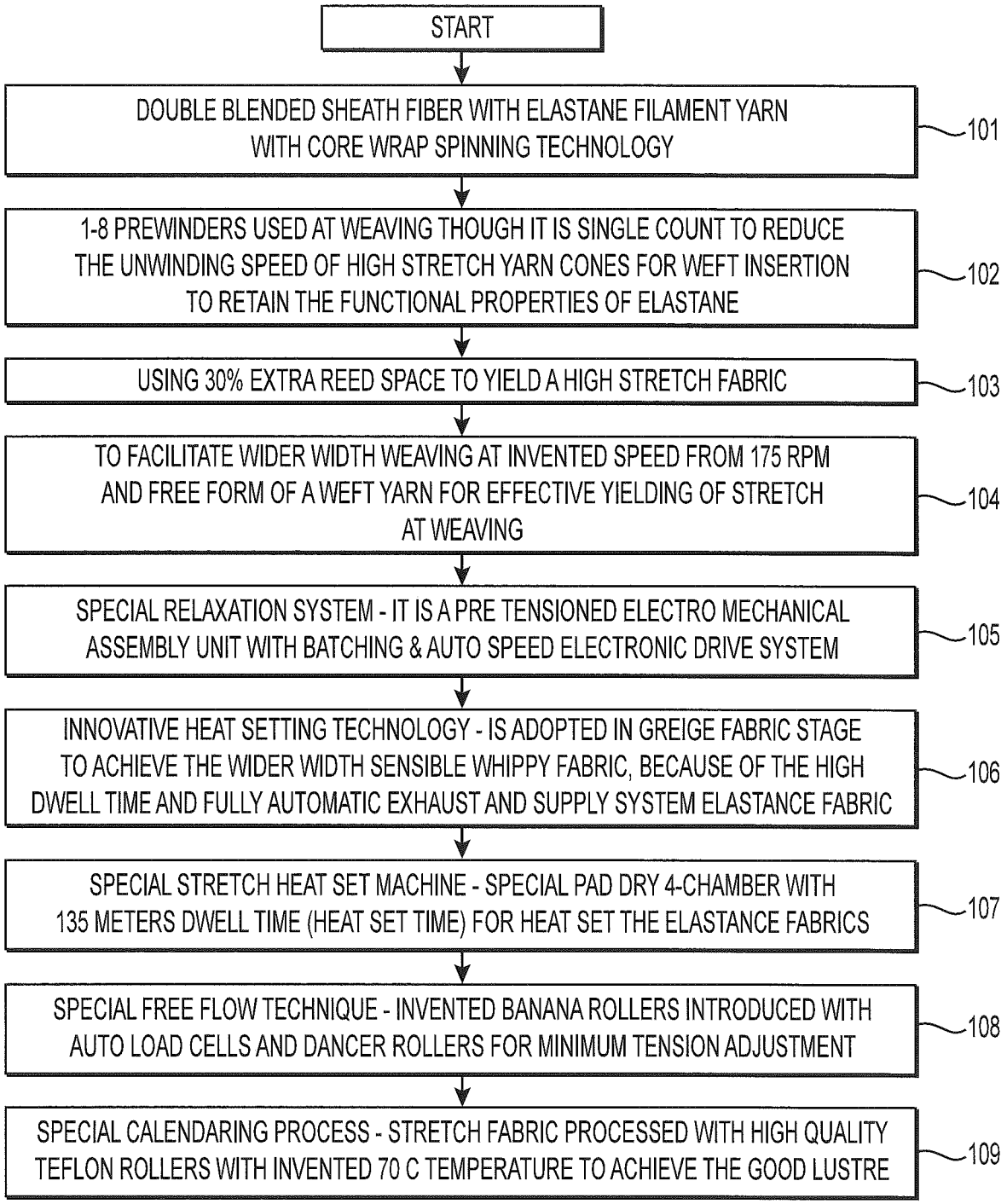
FIG. 1 is a process flow chart focusing on several innovative and important steps for producing the fabric of the invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

The invention relates in part to a woven textile fabric that possess characteristics that make it particularly useful as a bed linen, although the fabric is not limited to this use. Such characteristics include but are not limited to allowing the user to experience a comfortable fit, whether the fabric is used in an article of clothing or in a bed linen. The woven fabric of the invention allows for freedom of movement and possesses qualities such as shape retention, excellent drapeability and crease recovery. The woven fabric also has enhanced durability after many wash cycles and a wrinkle-free look at ironing. The particular combination of fibers present in the woven fabric of the invention provides the fabric with natural antimicrobial properties, which is an important quality in, for example, ben linen. The woven fabric is also lightweight, soft, smooth and supple. It allows for significant friction reduction when used as a bed linen, e.g., when the person sleeping is rolling over in bed. The woven fabric is particularly useful as a fitted sheet for deep mattress sizes. Unlike other fabrics used for fitted sheets on deep mattresses, the woven fabric of the invention maintains its integrity and properties during use. This includes maintaining its comfortable feel while also maintaining the appropriate stretch characteristics.

In one embodiment of the invention, the woven textile fabric has the following construction: 60 s regenerated cellulosic fabric/cotton (70/30)×50 s regenerated cellulosic/cotton/spandex (60/30/10); 212×90. In this embodiment, the weave may be 4/1 satin and the fabric may have the following composition: about 65% to about 69% regenerated cellulosic fiber, about 27% to about 33% cotton and about 2% to about 4% spandex.

In another embodiment of the invention, the woven textile fabric has the following composition: about 67% regenerated cellulosic fiber, about 30% cotton and about 3% spandex.

The woven textile fabric of the invention includes both warp yarn and weft yarn. In one embodiment of the invention, the warp count ranges from a 2 s count to a 140 s count. The weft count ranges from a 2 s count to a 170 s count.

The fabric construction may range from 44 ends/inch to 300 ends/inch and from 30 picks/inch to 600 picks/inch. The associated thread count may range from 80 to 2000.

In various aspects of the invention the weave may range between 1/1 plain and 2/1 twill and 4/1 satin or derivatives or reverses of these weaves. In other embodiments of the invention, the weave may be a Dobby weave, a jacquard weave or any combination of the aforementioned weaves.

The ability of the woven fabric to stretch is a very important characteristic of the invention. The stretch range of the woven textile fabric is from about 3% to about 50%. This helps to provide the important stretch to the fabric, which is particularly useful in fitted sheets for deep mattress sizes.

The woven fabric of the invention and the method of making the fabric have additional features that are discussed in more detail below. In one aspect of the invention, it is important to facilitate development of a weft filament yarn within the range of about 15 denier to about 150 denier with an elastane content between about 2% and about 12%. In one aspect, the weft filament yarn is about 40 denier with an elastane content of about 15%. This is achieved in part through the use of core spun technology, which imparts to the fabric excellent stretch properties that are useful when the fabric is used, for example, as a bed linen.

In one aspect of the invention, the weft yarn is made of long staple cotton up to about 36 mm in 50 s count to provide the required weft tear and tensile strength. This is an innovative feature of the yarn used in the fabric of the invention, as the typical count for yarn in similar fabrics ranges from 100 s to 120 s.

In one aspect of the invention, up to 8 pre-winders may be used in weaving the fabric of the invention. Despite the single count, this method step is employed to reduce the winding speeds of high stretch yarn to below 200 meters/minute, to reduce unwinding speeds of cones for insertion, and to retain the functional properties of the elastane.

In another aspect of the invention, the method includes a step whereby between 5% and about 30% extra reed space is used in making the fabric of the invention. This approach is in contrast to the 5% or less extra reed-space used in conventional methods to yield a high stretch in typical bedding fabrics.

The inventors have developed a woven textile fabric that has a particular combination of warp and weft count to impart to the fabric the same handle and feel as a non-stretch fabric with the same thread count.

In one aspect, the invention embraces a new method to produce a fabric that facilitates weaving a 124" width grey fabric at an innovative speed from 150 rpm to 700 rpm and producing a free form of a weft yarn for effective yielding of stretch at weaving. This effectively locks in the stretch property of the elastane inside the fabric without loss. A speed of about 175 rpm has been found to be effective at locking in this stretch property.

In another aspect of the invention, specialized weft accumulators up to maximum of 8 (number of accumulators used is 1 to 8) are used to facilitate feeding of stretch yarn to a high speed weaving run at 150 meters/min to 1500 meters/min.

An additional attribute of the woven fabric of the invention and the method of making the same includes use of a special fabric relaxation system. The special relaxation system may be a pre-tensioned electro mechanical assembly unit with a batching system that has an auto-speed electronic drive system. Passing the elastane fabric rolls through this system provides less stretch (less fabric tension) and assists in relaxing the fabric form. The fabric is folded in a highly relaxed condition.

A special stretch heat set machine may be used in certain aspects of the method to make the fabric of the invention. For example, the method may employ a PAD dry 4-chamber machine with 135 meters dwell time (heat set time) for heat setting the elastane fabric. The Chamber wise set parameters are shown below:

1. Chamber 1 temperature—170° C.
2. Chamber 2 temperature—170° C.
3. Chamber 3 temperature—180° C.

4. Chamber 4 temperature—180° C.
5. Exhaust fan settings for first 2 chambers—40%
6. Exhaust fan settings for $3^{rd}$ and $4^{th}$—60%
7. Machine speed—35 mpm to 40 mpm.

Regarding the above chamber parameters, there is a 10% tolerance for machine speed, depending on the fabric thread count. Additionally, there is a 10° C. tolerance in the temperature range, depending on thread count of fabric.

In one aspect of the invention, the innovative heat setting technology is adopted in the greige fabric stage to achieve the wider width fabric of the invention. Such technology is used in part because of the high dwell time and the presence of the fully automatic exhaust and supply system for the elastane fabric. The heat set process is maintained without any device to meter the heat set variation. Due to this approach, the inventors have produced uniform width throughout each batch/lot of fabric.

In another aspect, the method of the invention employs a special route for stretch fabrics that includes controlling the fabric movements and fabric guiding. Normally, all elastane fabrics are made in accordance with the following process route: A-Frame batching+Heat set (85 meters length with constant 180° C. temperature)+CBMR (Continuous bleaching and Mercerizing range)+Dyeing+Finishing. The innovative route of the method step of this invention includes the following: Greige rolls batched in trolleys+Heat set in the 135 meter dwell time PAD Dry machine with auto fabric stretch control system+CBMR with a lower tension control system. In this embodiment, the electronic tension control system operates at an innovative and unexpected 1.0 bar of air pressure, rather than the standard 2.5 bar of air pressure.

Another aspect of the invention includes a special free flow technique. While running the stretch fabrics, the inventors have made a fine adjustment in the banana rollers by introducing auto load cells and Dancer rollers for very minimum tension adjustment in each machine.

One aspect of the method of the invention employs a special calendaring process. In this method step, the stretch fabric is processed and passed through high quality Teflon rollers at an innovative temperature of about 70° C., rather than the more typical temperature of about 150° C. for achieving good shine and brightness in the fabric.

Turning to the drawings, FIG. 1 is a process flow chart showing several innovative method steps for producing the fiber of the invention. The process flow chart also emphasizes that certain method steps are important to producing a woven textile fabric having the exceptional qualities of the fabric of the invention.

An early step 101 in the method of making the invention is producing a double blended sheath fiber with elastane filament yarn for the weft using a core wrap spinning technology. This is shown in more detail in FIG. 2.

Another step (weaving step 102) relies on the use of eight (8) pre-winders at the weaving stage to reduce the unwinding speed of high stretch yarn cones for weft insertion. This step, not typically used for single count yarn, helps to retain the functional properties of elastane in the fiber of the invention.

Step 103, performed using a loom apparatus, relies on the use of about 30% extra Reed space to yield a high stretch fabric. This also facilitates wider width weaving 104 at a speed of from 150 rpm to 700 rpm, (e.g., about 175 rpm) and provides for a free form weft yarn for effective yielding of stretch at weaving.

The method of making the fiber of the invention may also include use of an innovative relaxation system (see FIG. 4) in a relaxation step 105. This special relaxation system is a pre-tensioned electro-mechanical assembly unit with a batching and auto speed electronic drive system.

Figure 5:
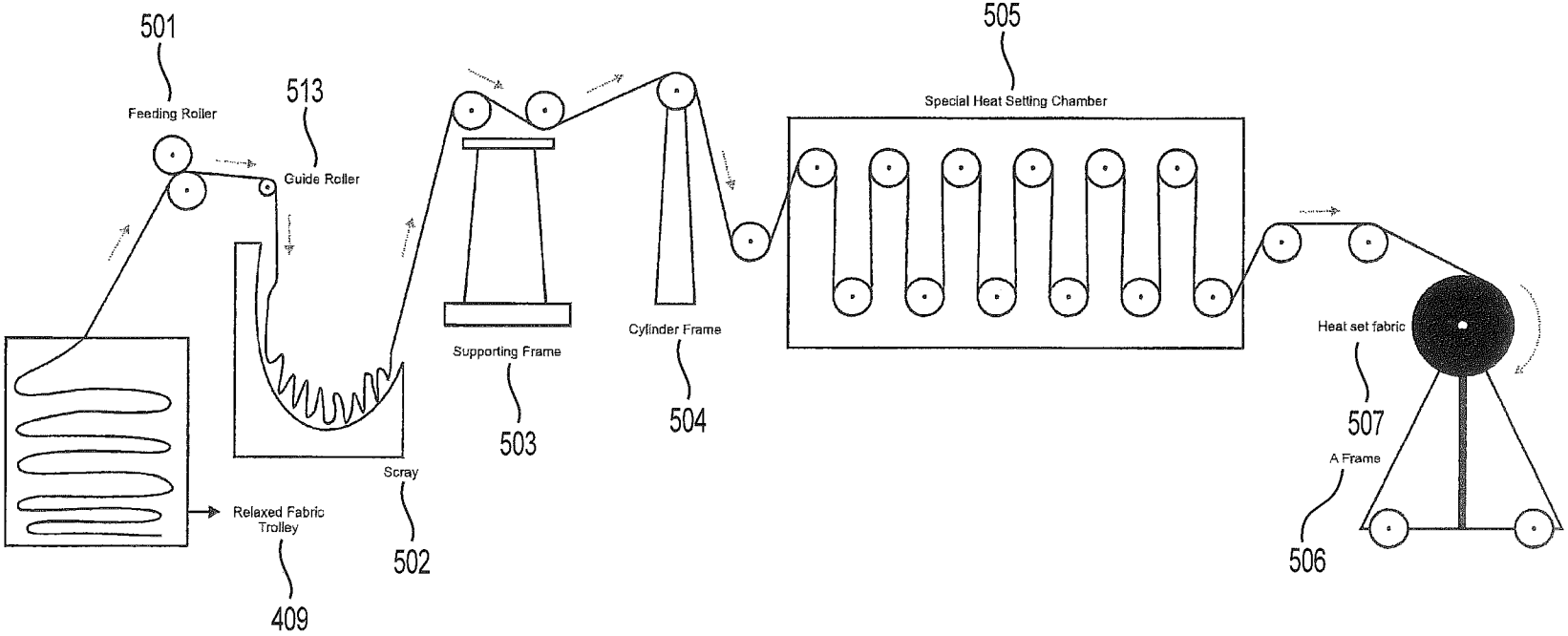
FIG. 5 is a schematic diagram showing a machine used for a unique heat setting process step as used in making the fabric of the invention.

The process of making the fiber of the invention may also include an innovative heat setting technology step 106, which is used in a greige fabric stage to achieve the wider width fabric of the invention, because of the high dwell time and fully automatic exhaust and supply system elastane fiber (see FIG. 5).

The method of making the fiber of the invention also includes use of a special stretch heat set machine (see FIG. 6) in step 107. In one embodiment, this machine is a PAD dry-4-chamber unit with 135 meters of Dwell time (heat set time) to heat set the elastane fabric.

The method also includes use of a unique free flow technique in step 108, whereby the inventors employ innovative banana rollers that are introduced with auto load cells and dancer rollers for minimum tension adjustment.

The method further includes a special Calendaring process step 108 whereby the stretch fabric is processed with high quality Teflon rollers and using an innovative temperature setting of about 70° C. to achieve a fabric with good luster.

Figure 2:
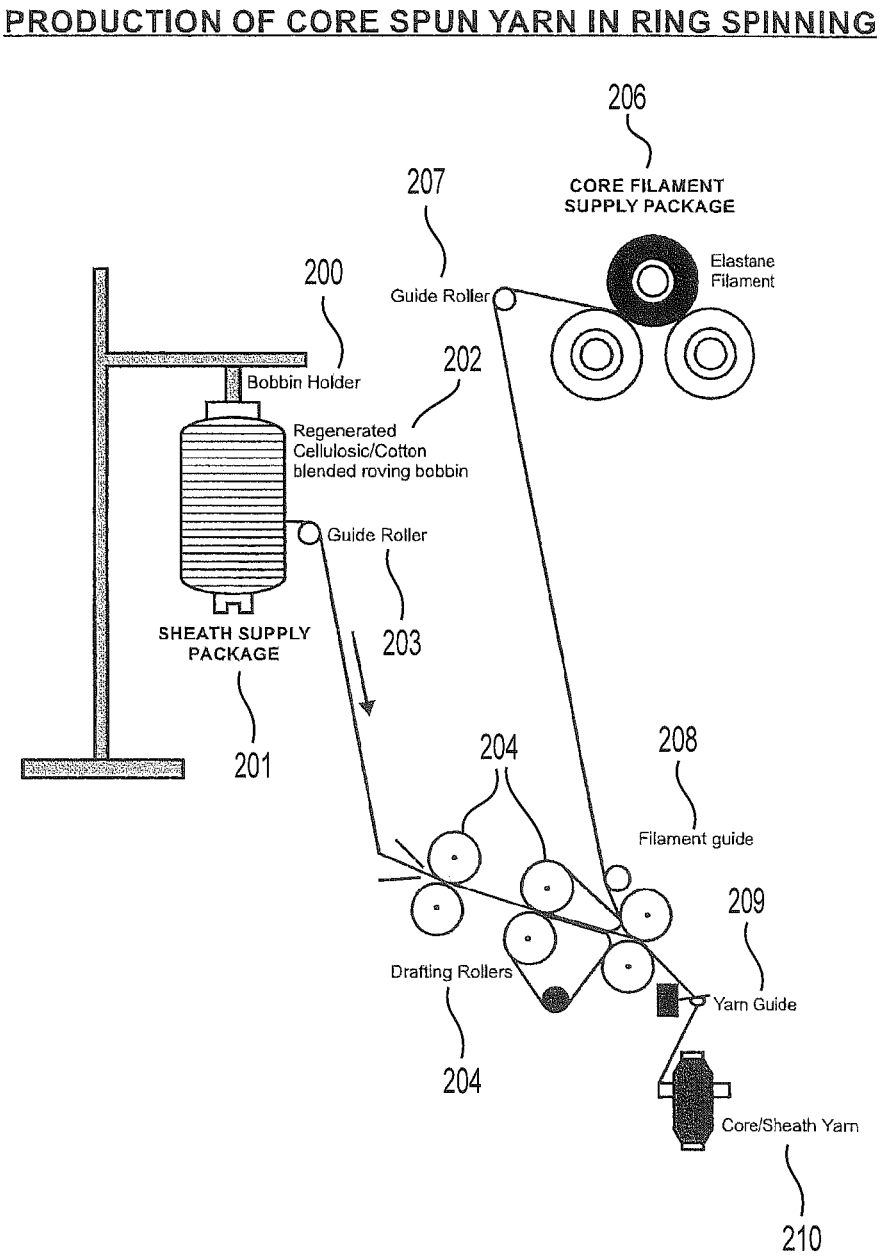
FIG. 2 is a schematic diagram showing production of core spun yarn in ring spinning, a step used to impart desirable properties to the fabric of the invention.

FIG. 2 shows the production of core spun yarn in the ring spinning step. A sheath supply package 201 attached to bobbin holder 200 holds a regenerated cellulosic/cotton fiber blend wrapped around roving bobbin 202. The blended fiber is directed through guide roller 203 and drafting rollers 204 to further blend with the core filament (an elastane filament). The elastane filament is supplied from a core filament supply package 206 and is directed via guide roller 207 to filament guide 208 where it provides the core to the regenerated cellulosic/cotton sheath fibers. The blended core/sheath fiber is then directed via a yarn guide 209 to a core/sheath yarn bobbin 210 prior to further processing.

Figure 3:
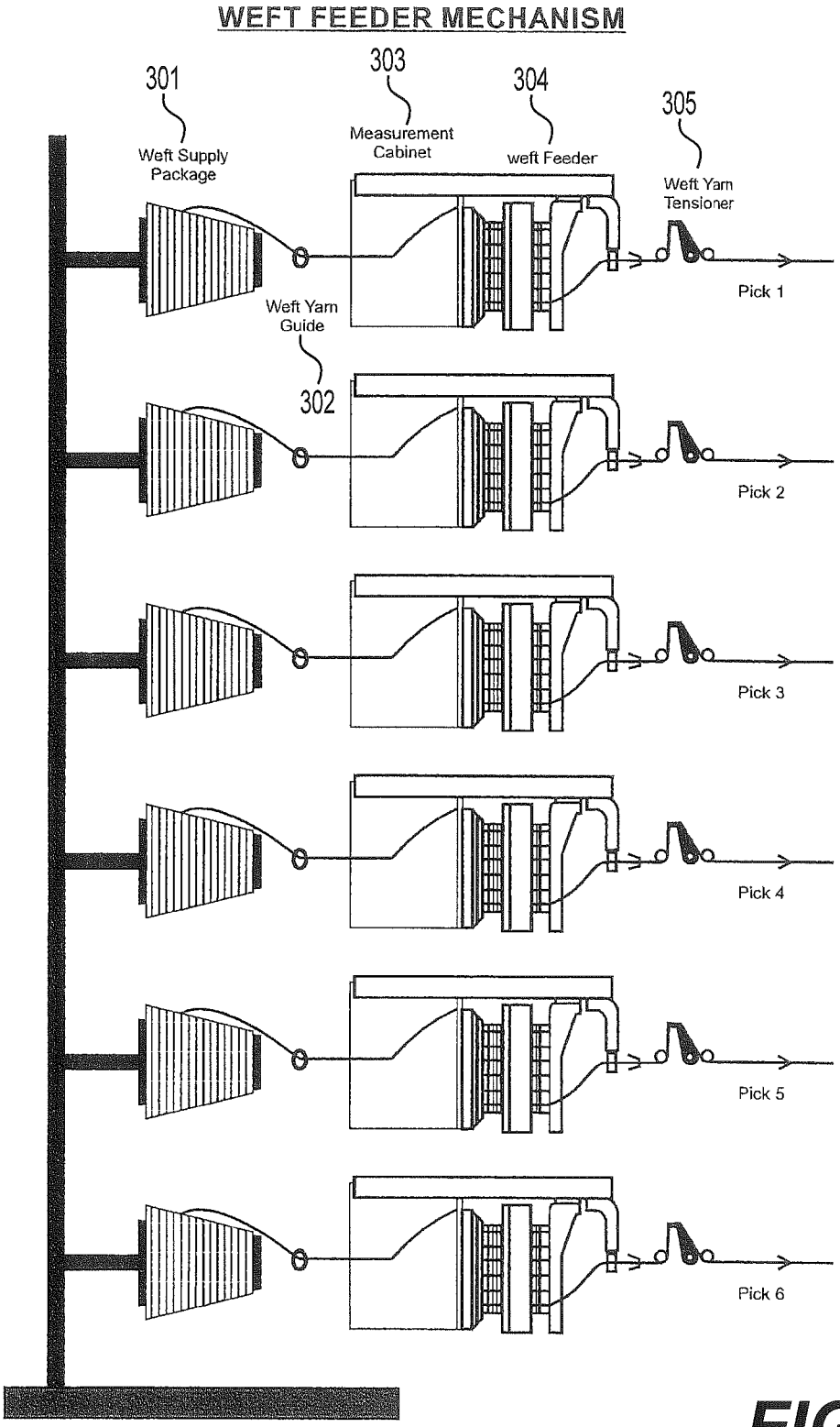
FIG. 3 is a schematic diagram showing production of a weft feeder mechanism used in making the fabric of the invention.

FIG. 3 is a schematic showing the weft feeder mechanism used to produce the fiber of the invention. Weft yarn is directed from a weft yarn supply packages 301 arranged in parallel through weft yarn guides 302. The weft yarn from each supply package is then directed into measurement cabinets 303, onto and through weft feeders 304, to weft yarn tensioners 305. Like the weft yarn supply packages 301, the measurement cabinets 303, weft feeders 304 and weft yarn tensioners 305 are also arranged in parallel. Each of the separate weft yarns is then directed as picks to the weaving steps.

Figure 4:
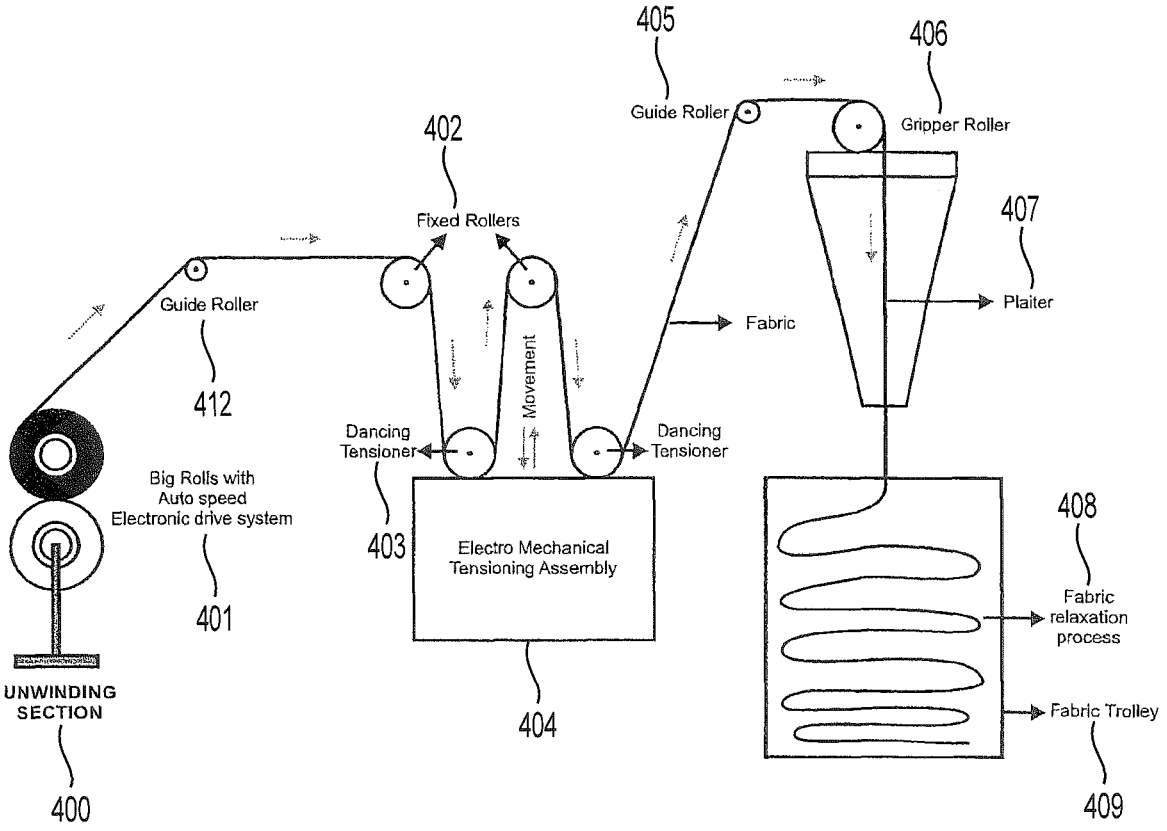
FIG. 4 is a schematic diagram showing a special fabric relaxation system used in making the fabric of the invention.

FIG. 4 is a schematic of a special fabric relaxation system used in the method to make the fabric of the invention. After the unwinding section 400, the fabric is wound on large rolls as part of an auto speed electronic drive system 401. The fabric is directed through a series of guide rollers 412 and fixed rollers 402 to a dancing tensioner system 403 mounted to and driven by electromechanical tensioning assembly 404. The fabric is then directed via guide roller 405 and gripper roller 406 to plaiter 407, and from there though fabric relaxation unit 408 and finally to a fabric trolley 409.

FIG. 5 is schematic for an innovative heating setting sub-process used in the method to make the fabric of the invention. From the fabric trolley 409 discussed above with respect to FIG. 4, the fabric is fed through feed rollers 501 and guide roller 513 to a scray 502, over a supporting frame 503, over a cylinder frame 504, through a special heating chamber 505, and onto a heat set fabric 507 positioned on A frame 506 before further processing. The heat setting chamber is innovative insofar as it has a special PAD dry 4-chamber unit with 135 meters of dwell time (heat set time). This is important to maintain the excellent properties provided by the elastane fiber in the fabric of the invention.

The dwell time has a 10 meter tolerance based on fabric thread count and the particular auto exhaust system used in the heat setting chamber.

Figure 6:
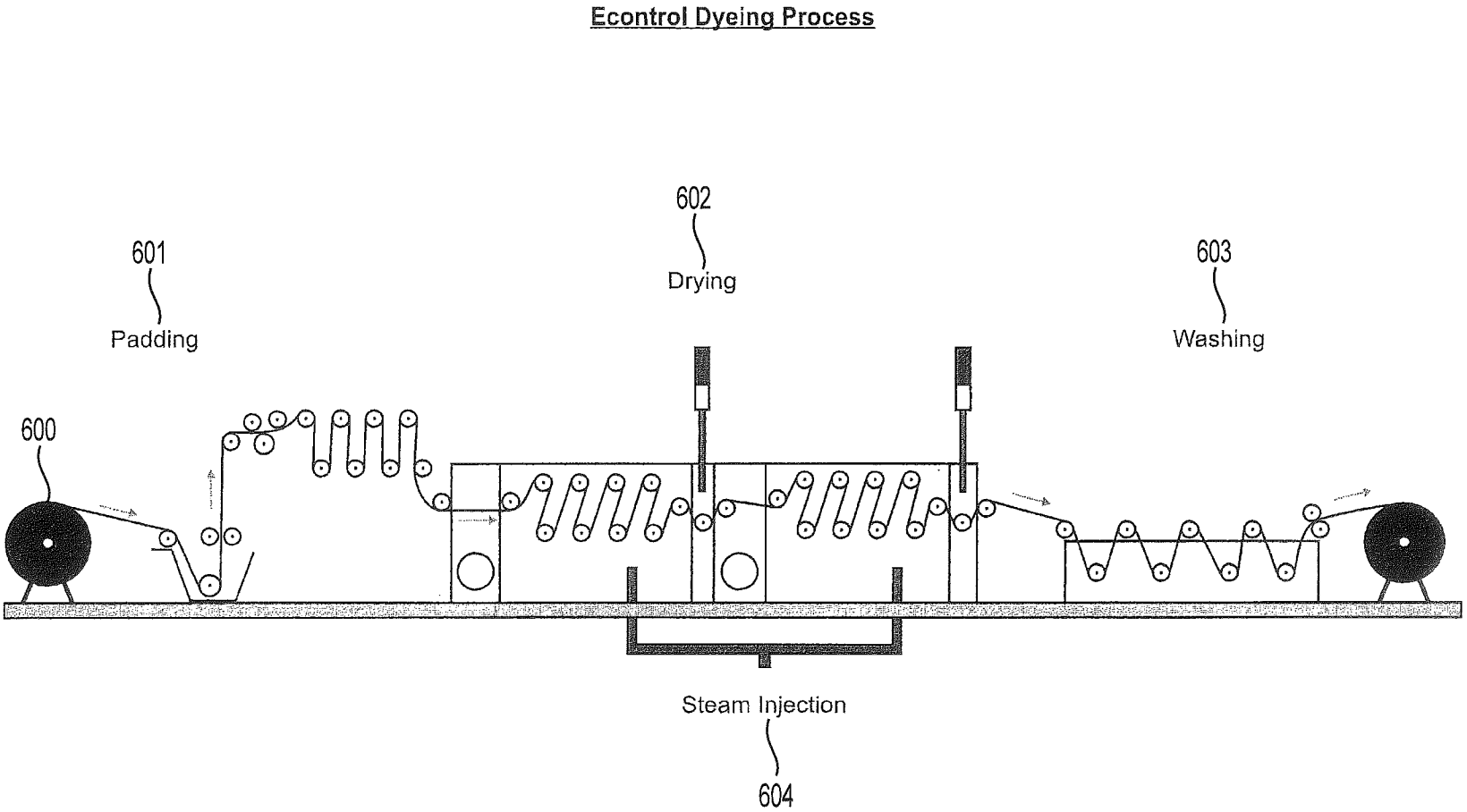
FIG. 6 is a schematic diagram showing of an electronic control system used in making the fabric of the invention.

FIG. 6 presents an Econtrol dyeing process that shows progression of the fabric from roller 600 through a padding phase 601, a drying phase 602, and a washing phase 603. Steam is injected into a portion 604 of the drying chamber in this sub-process of making the fiber of the invention.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A woven textile fabric comprising warp yarn and weft yarn and having a composition comprising a regenerated cellulosic fiber in an amount lying in a range of 60% to 70% of the composition, cotton in an amount of 30% of the composition, and an elastane fiber in an amount lying in a range of 0% to 10% of the composition, wherein the warp yarn is a single spun yarn and the weft yarn is a single core spun yarn, wherein the weft yarn comprises a core sheath ratio of 10:90 and a core filament count lying in a range of 40 denier to 50 denier elastane, wherein a fabric stretch range is 30% and above.

2. The woven textile fabric of claim 1, wherein the weft yarn is a core spun yarn comprising an elastane fiber core surrounded by a sheath of blended regenerated cellulosic fiber and cotton.

3. The woven textile fabric of claim 1, wherein the elastane fiber is spandex.

4. The woven textile fabric of claim 1, wherein the regenerated cellulosic fiber is lyocell.

5. The woven textile fabric of claim 3, wherein the regenerated cellulosic fiber is present in an amount ranging from about 65% to about 69%, the cotton is present in an amount ranging from about 27% to about 33%, and the spandex is present in an amount ranging from about 2% to about 4%.

6. The woven textile fabric of claim 5, wherein the regenerated cellulosic fiber is present at about 67%, the cotton is present at about 30%, and the spandex is present at about 3%.

7. The woven textile fabric of claim 1, wherein the weave is a 4/1 satin weave.

8. The woven textile fabric of claim 1, wherein the thread count is 300+/−5.

9. The woven textile fabric of claim 1, wherein the fabric construction is 220 ends/inch+/−5 ends/inch and 90 picks per inch+/−5 picks per inch.

10. The woven textile fabric of claim 1, wherein the warp count is 60 s count and the weft count is 50 s count.

11. The woven textile fabric of claim 2, the weft yarn comprises long staple cotton between 28 mm and 36 mm in length in a 50 s count.

12. The woven textile fabric of claim 3, wherein the spandex content of the weft yarn is from about 2% to about 12%.

13. A method of making a fabric comprising warp yarn and weft yarn and having a composition comprising a regenerated cellulosic fiber, cotton and an elastane fiber, the method comprising the step of:

reducing the tension in the weft yarn using an electromechanical assembly unit with a batching system and an auto speed electro drive system; and stretching the weft yarn using a PAD dry 4-chamber heating unit with a dwell time of 135 meters, wherein the Chamber 1 temperature is about 170° C., the Chamber 2 temperature is about 170° C., the Chamber 3 temperature is about 180° C., and the Chamber 4 temperature is about 180° C.

14. The method of claim 13, wherein each of the four chambers in the heating unit comprises an exhaust fan, and wherein the exhaust fan settings for Chamber 1 and Chamber 2 is 40% and the exhaust fan setting for Chamber 3 and Chamber 4 is 60%.

15. The method of claim 14, wherein the heating unit has a machine speed of from 35 mpm to 40 mpm.

16. The method of claim 14 further comprising a step of batching greige rolls in trolleys and a step of operating a continuous bleaching and Mercerizing range with a tension control system running at less than 2.5 bar air pressure.

17. The method of claim 16, wherein the tension controls system operates at about 1 bar of air pressure.

18. The method of claim 14, further comprising a calendaring step, wherein the fabric is passed through polytetrafluoroethylene rollers at a temperature of about 70° C.

* * * * *